US006494393B1

(12) United States Patent
Berselli et al.

(10) Patent No.: US 6,494,393 B1
(45) Date of Patent: Dec. 17, 2002

(54) MILL FOR GRINDING LOOSE MATERIALS

(76) Inventors: Giorgio Berselli, Via Giardini Nord, 11496 - 41020 Montagnana di Serramazzoni (IT); Emer Sghedoni, Via Tagliamento, 25 - 41049 Sassuolo (IT)

( * ) Notice: Subject to any disclaimer, the term of this patent is extended or adjusted under 35 U.S.C. 154(b) by 0 days.

(21) Appl. No.: 09/714,626

(22) Filed: Nov. 16, 2000

Related U.S. Application Data

(63) Continuation of application No. PCT/EP99/03355, filed on May 14, 1999.

(30) Foreign Application Priority Data

May 19, 1998 (IT) ..... M098A0111

(51) Int. Cl.[7] ..... B02C 17/08
(52) U.S. Cl. ..... 241/175; 241/176; 241/180
(58) Field of Search ..... 241/175, 176, 241/180

(56) References Cited

U.S. PATENT DOCUMENTS 3,840,191 A 10/1974 Herzog
4,057,191 A 11/1977 Ohno

FOREIGN PATENT DOCUMENTS

GB 2 257 379 1/1993

*Primary Examiner*—William Hong
(74) *Attorney, Agent, or Firm*—Wolf, Greenfield & Sacks, P.C.

(57) ABSTRACT

A mill for grinding loose materials, which comprises a closed container provided with at least one opening for introducing and removing the materials and has, at its two poles, a first coupling shaft and a second coupling shaft articulated thereto, a fixed frame which has centering elements for said first shaft and supports a driving shaft which is actuated so that it can rotate continuously, a flange which is fixed to said driving shaft and has eccentric elements for supporting said second shaft with a rotary coupling element interposed, said eccentric elements being adapted to make said second shaft perform a substantially circular orbit.

18 Claims, 4 Drawing Sheets

MILL FOR GRINDING LOOSE MATERIALS

CROSS-REFERENCE TO RELATED APPLICATIONS

This application is a continuation of application number PCT/EP99/03355 filed on May 14,1999.

BACKGROUND OF THE INVENTION

The present invention relates to a mill for grinding loose materials.

It is known that mills of the gravity or centrifugal-grinding type are used to grind products such as enamels, grits and the like.

These mills contain a plurality of balls which act by gravity or by centrifugal force and break up the material between the balls and/or between the balls and the internal surface of the mill.

These mills suffer some drawbacks, among which the fact that they require disadvantageously long times for introducing, grinding and unloading the materials, require a considerable amount of balls or beads to effectively break up the product contained therein, and allow to grind only specific quantities of the material that is introduced, said quantities being closely linked to the quantity of balls and to the dimensions of said mills.

It can in fact be noted that in the case of conventional gravity mills grinding occurs mainly on the bottom of the mill, whereas in the case of centrifugal mills breakup occurs mainly along the material surface of the mill; accordingly, in both cases it is convenient for the amount of product to be ground to be directly proportional to the number of balls and to the size of the mill in which it is contained.

Furthermore, mills that work by centrifugal force must have very small dimensions, and therefore very small capacities, because they require very high power levels to move the masses.

SUMMARY OF THE INVENTION

The aim of the present invention is to eliminate the above drawbacks of conventional mills by providing a mill for grinding loose materials which allows to minimize the quantity of the grinding media for effective breakup, to limit the power level required and the actual time required for introduction, grinding and unloading, and to grind different quantities of material regardless of the dimensions of said mill.

Within the scope of this aim, an object of the present invention is to provide a structure which is simple, relatively easy to be manufactured, safe in use, effective in operation and having a relatively low cost.

This aim, this object and others are achieved by the present mill for grinding loose materials, characterized in that it comprises a closed container which is provided with at least one opening for introducing and removing the materials and has, at its poles, a first coupling shaft and a second coupling shaft articulated thereto, a fixed frame which has centering means for said first shaft, said frame supporting a driving shaft which is actuated so that it can rotate continuously, and a flange which is fixed to said driving shaft and has eccentric means for supporting said second shaft with a rotary coupling element interposed, said eccentric means being adapted to make said second shaft perform a substantially circular orbit.

BRIEF DESCRIPTION OF THE DRAWINGS

Further characteristics and advantages of the present invention will become apparent from the detailed description of a preferred but not exclusive embodiment of a mill for grinding loose materials according to the invention, illustrated only by way of non-limitative example in the accompanying drawings, wherein.

DESCRIPTION OF THE PREFERRED EMBODIMENTS

Figure 1:
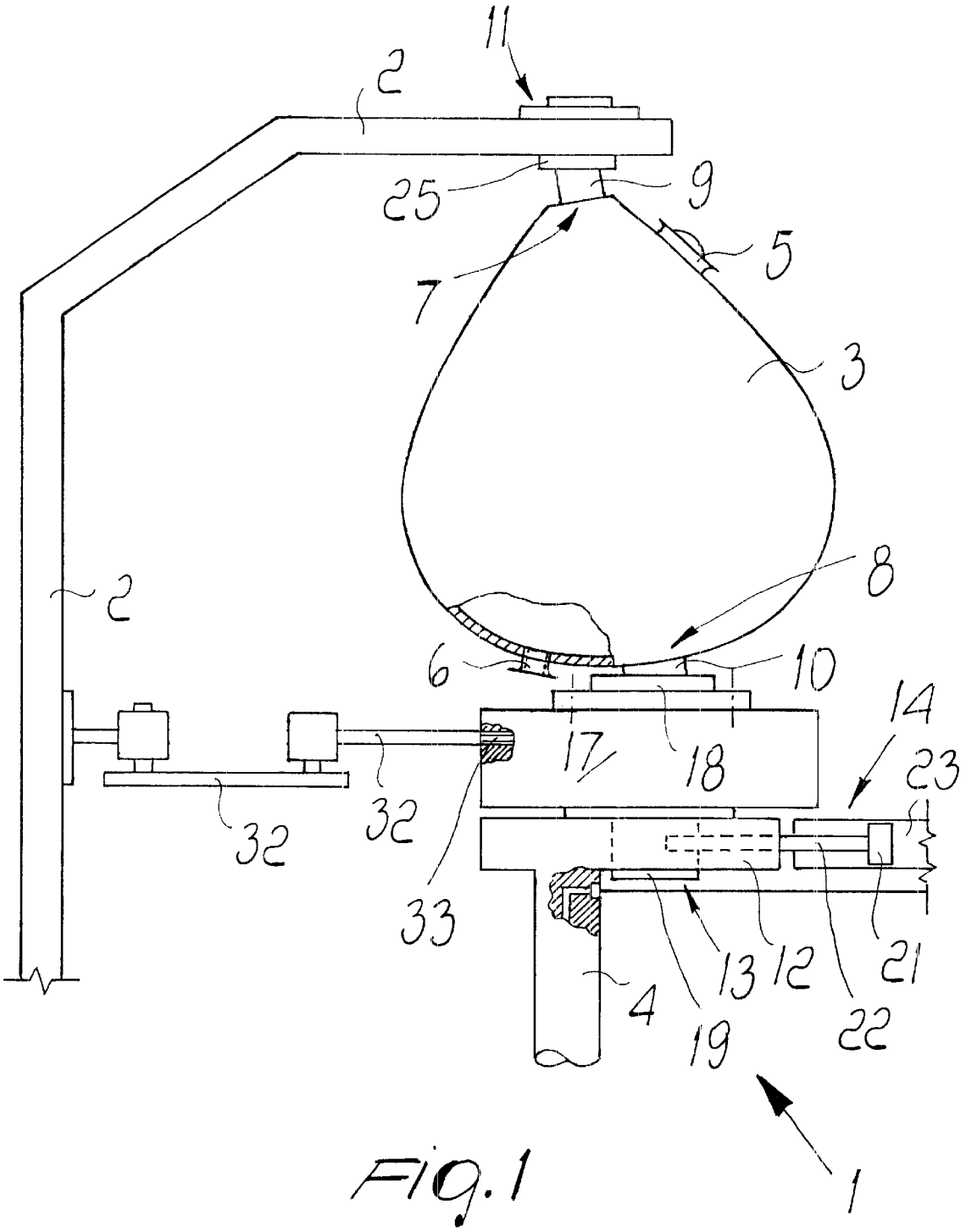
FIG. 1 is a partially cutout front view of a mill for grinding loose materials according to the invention.
Figure 2:
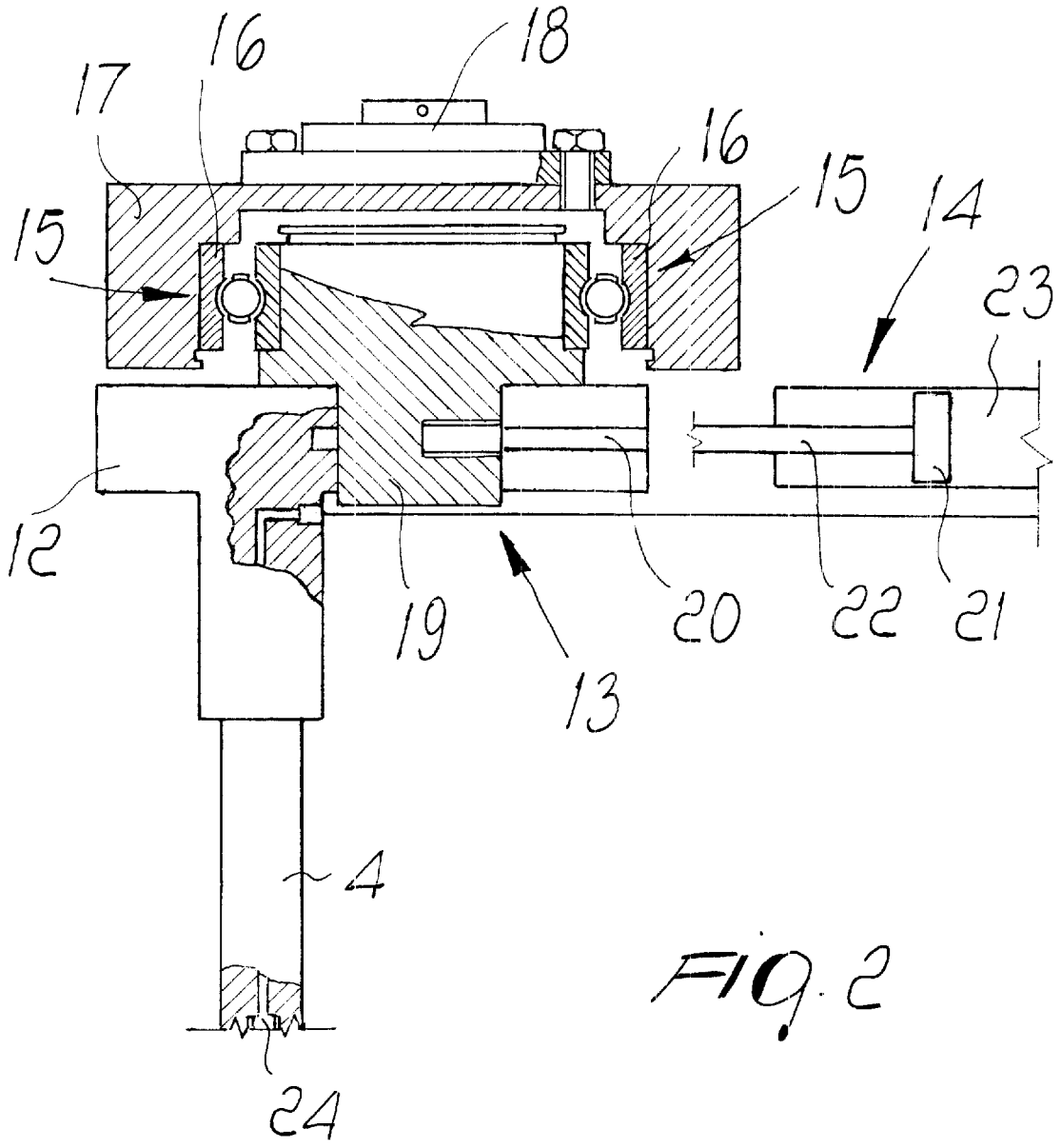
FIG. 2 is an enlarged-scale sectional front view of the actuation assembly of the mill of FIG. 1.
Figure 3:
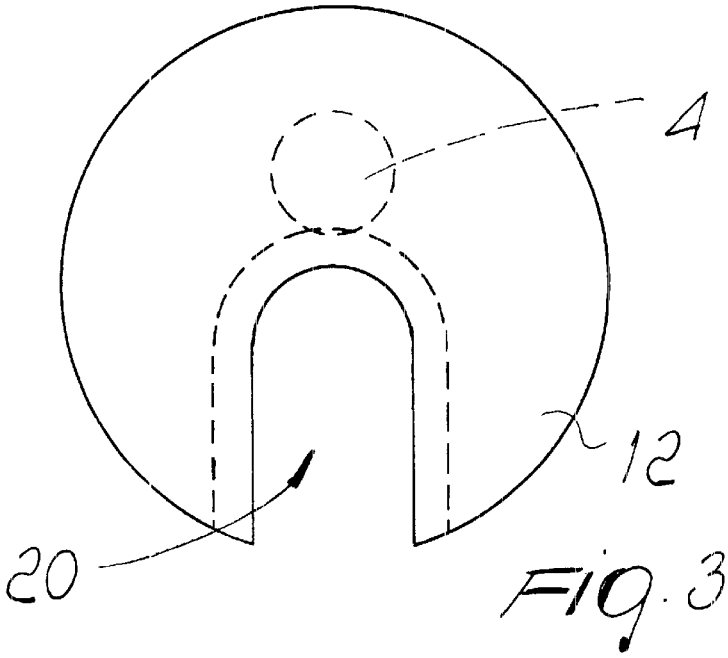
FIG. 3 is a top view of the flange of the assembly of FIG. 2.
Figure 4:
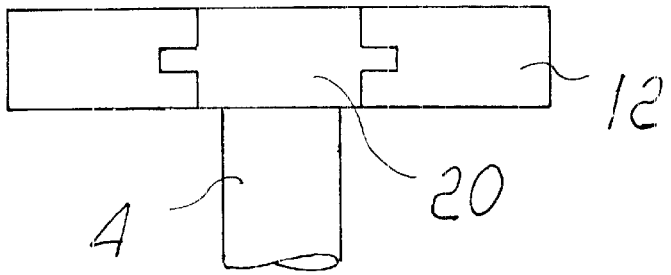
FIG. 4 is a front view of the flange of FIG. 3.
Figure 5:
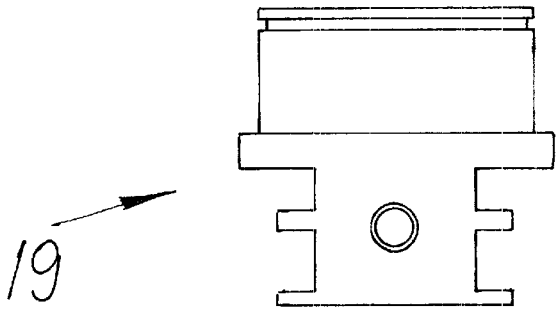
FIG. 5 is a front view of a detail of the eccentricity means of the assembly of FIG. 2.
Figure 6:
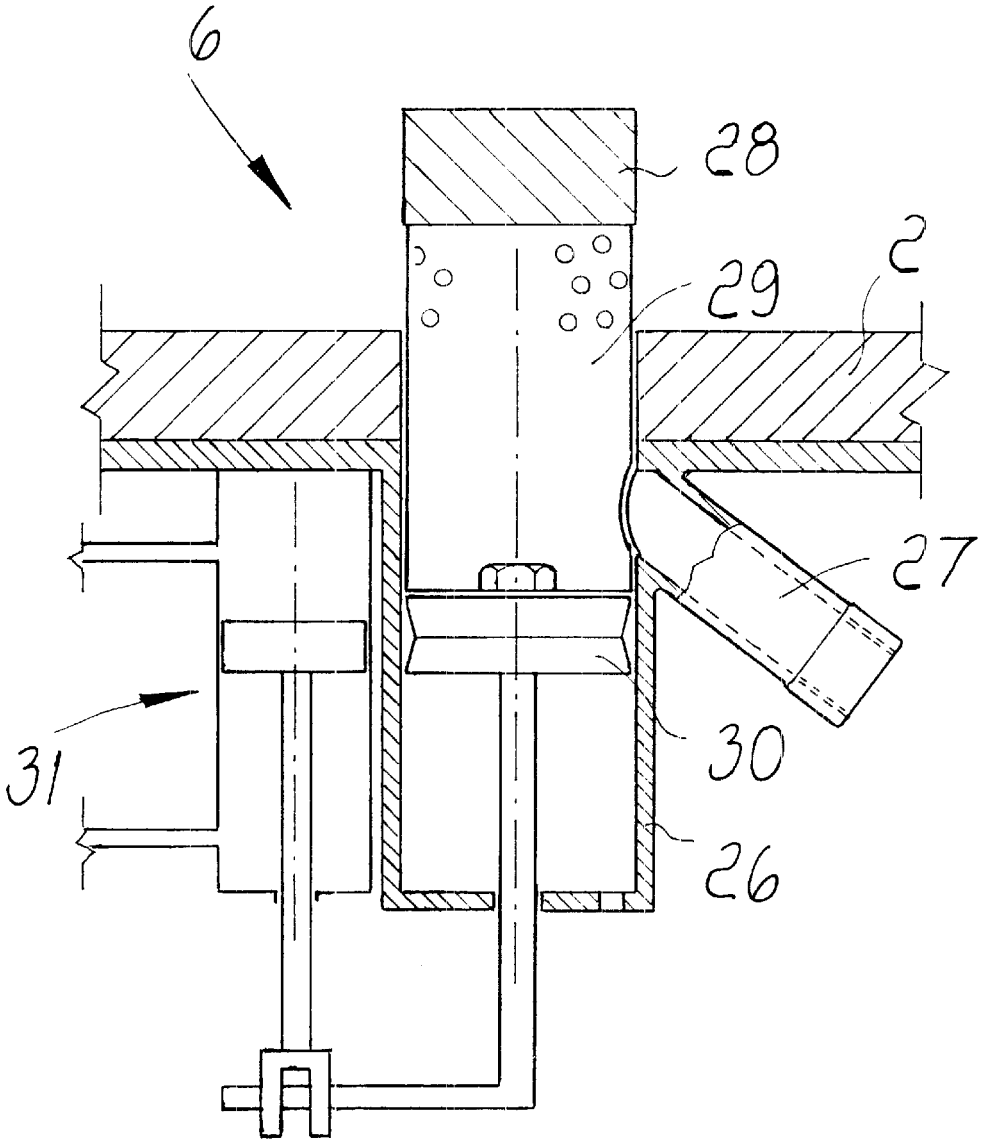
FIG. 6 is a partially sectional enlarged-scale front view of the removal opening of the mill according to the invention.

With reference to the above figures, the reference numeral 1 generally designates a mill for grinding loose materials according to the invention.

The mill 1 comprises a fixed frame 2 for supporting a closed container 3 and a driving shaft 4 which is actuated so as to rotate continuously.

The container 3 has, in an upward region, a loading opening 5 for introducing the materials and has, in a downward region, a removal opening 6; a first coupling shaft 9 and a second coupling shaft 10 are articulated to poles 7 and 8 of the container.

The fixed frame 2 has centering means 11 for the first shaft 9 and supporting means, not shown, for the driving shaft 4 on which a circular flange 12 is fixed which has eccentric means 13 for supporting the second shaft 10.

The eccentric means 13 allow the second shaft 10, and accordingly the pole 8 of the container 3, to trace a substantially circular orbit, are adjustable and can be coupled to translatory motion elements 14 which are adapted to determine the dimensions of said orbit.

Between the means 13 and the shaft 10 there is an interposed rotary coupling element 15, such as a rolling ball bearing in which the outer ring 16 is coupled to the second shaft 10 by means of a bush 17 which is rigidly coupled thereto with a self-aligning support 18 interposed.

The eccentric means 13 comprise a sliding block 19 which is slideable in a radial seat 20 formed in the flange 12 and is rigidly mounted inside the bearing 15.

The sliding block 19 is associated with the translatory motion elements 14, which determine its movement along the radial seat 20.

The translatory motion elements 14 are fluid-actuated type and comprise a piston 21 which is rigidly coupled to the sliding block 19 by means of a stem 22, which is slideable inside a jacket 23 which is connected to an inlet 24 for the fluid that is adapted to move the piston 21 longitudinally.

The container 3 is arranged substantially vertically in the frame 2 and has the first shaft 9 at the upper pole 7 and the second shaft 10 at the lower pole 8.

In a different embodiment of the mill according to the invention, the container might be installed in the frame in a substantially horizontal position and be coupled to it laterally.

Advantageously, the centering means 11 comprise a self-aligning support 25 which allows to correctly position the container 2 for every value of achieved eccentricity.

The opening 6 for removing the ground materials continues outwards with a tubular element 26 which is provided with a lateral unloading duct 27 and is associated with a closure plug 28, a perforated jacket 29 and a control element 30 which are mutually coaxial and mutually rigidly coupled.

The plug, the jacket and the control element can be actuated so as to slide along the tubular element 26 so that in the configuration for unloading the material the plug 28 remains raised and the jacket 29 is connected both to the inside of the container 3 and to the lateral duct 27 and so that in the closure configuration the plug 28 closes the opening 6 with a perfect seal, thus preventing the materials being ground from escaping.

The assembly constituted by the closure plug 28, the jacket 29 and the control element 30 are rigidly associated with a double-acting jack 31 which is adapted to move the plug from the closure configuration to the unloading configuration and viceversa.

In this manner, the removal of the ground product occurs very rapidly and automatically without requiring the mill to stop and/or the intervention of specialized labor.

Conveniently, an articulated arm 32 is mounted on the frame 2, and its end 33 is coupled to the bush 17; said arm allows the container 3 to maintain its path during the rotation of the driving shaft 4.

The invention thus conceived is susceptible of numerous modifications and variations, all of which are within the scope of the inventive concept.

All the details may furthermore be replaced with other technically equivalent ones.

In practice, the materials used, as well as the shapes and the dimensions, may be any according to requirements without thereby abandoning the scope of the protection of the appended claims.

The disclosures in Italian Patent Application No. MO98A000111 from which this application claims priority are incorporated herein by reference.

What is claimed is:

1. A mill for grinding loose materials, comprising:

a closed container having a first and a second pole;

a fixed frame for supporting said container at said first and second poles;

a first coupling shaft articulated at said first pole;

a second coupling shaft articulated at said second pole;

a driving shaft;

a flange fixed to said driving shaft;

eccentric means with adjustable eccentricity, provided at said flange for supporting and actuating said second coupling shaft and said second pole to perform a substantially circular orbit;

translatory motion elements for varying the eccentricity of said eccentric means to achieve various dimensions of said circular orbit;

centering means, provided at said fixed frame, to provide correct positioning of said first coupling shaft for each of the various dimensions of said circular orbit;

a self aligning support provided at said second coupling shaft;

a rotary coupling element for connecting said second coupling shaft, through said self aligning support, to said eccentric means;

an articulated arm, mounted on said fixed frame and connected to said second coupling shaft for maintaining said container on a movement path corresponding to the circular orbit; and at least one opening, provided at said container for introducing and removing the materials.

2. The mill according to claim 1, wherein said eccentric means comprise a sliding block which is slideable in a radial seat formed in said flange and is rigidly mounted inside said rotary coupling element.

3. The mill according to claim 1, wherein said translatory motion elements are fluid-actuated.

4. The mill according to claim 1, wherein said container is arranged substantially vertically in said frame.

5. The mill according to claim 1, wherein said container is arranged substantially horizontally in the frame.

6. The mill according to claim 1, wherein said rotary coupling element comprises a bearing of the rolling ball type with an outer ring coupled to said second shaft.

7. The mill according to claim 1, wherein said container is provided, in a downward region, with a removal opening which continues toward the outside with a tubular element provided with a lateral unloading duct which is associated with a closure plug, a perforated jacket and a control element which are mutually coaxial, are mutually rigidly coupled and can be actuated so as to slide along said tubular element; in the configuration for unloading the material, the plug being raised and the jacket being connected both to the inside of the container and to said lateral duct; in the closure configuration, the plug being adapted to close said opening hermetically.

8. The mill according to claim 7, wherein said closure plug, said jacket and said control element are associated with a double-acting jack which is adapted to move said plug from the closure configuration to the unloading configuration and vice-versa.

9. A mill for grinding loose materials, comprising:

a closed container having a first and a second pole;

a fixed frame for supporting said container at said first and second poles;

a first coupling shaft articulated at said first pole;

a second coupling shaft articulated at said second pole;

a driving shaft;

a flange fixed to said driving shaft;

eccentric means with adjustable eccentricity, provided at said flange for supporting and actuate said second coupling shaft and said second pole to perform a substantially circular orbit;

centering means, provided at said fixed frame, to provide correct positioning of said first coupling shaft upon actuation of said second coupling shaft for performing said circular orbit;

a self aligning support provided at said second coupling shaft;

a rotary coupling element for connecting said second coupling shaft, through said self aligning support, to said eccentric means;

a loading opening, provided at said container for introducing materials to be ground therein;

a removal opening, provided at said container, for removing the ground materials; and control and plug elements which are actuatable, during operation of the mill, for opening and closing, respectively, said removal opening.

10. The mill according to claim 9, further comprising translatory motion elements, said eccentric means being adjustable by way of said translatory motion elements which determine the dimensions of said orbit.

11. The mill according to claim 10, wherein said eccentric means comprise a sliding block which is slideable in a radial seat formed in said flange and is rigidly mounted inside said rotary coupling element.

12. The mill according to claim 10, wherein said translatory motion elements are fluid-actuated.

13. The mill according to claim 9, wherein said container is arranged substantially vertically in the frame.

14. The mill according to claim 9, wherein said container is arranged substantially horizontally in the frame.

15. The mill according to claim 9, wherein said rotary coupling element comprises a bearing of the rolling ball type with an outer ring thereof coupled to said second shaft.

16. The mill according to claim 9, further comprising:

a tubular element, located at said removal opening and extending towards the outside of the container; a lateral unloading duct, provided at said tubular element; and a perforated jacket associated with said closure plug and said control element which are mutually coaxial, are mutually rigidly coupled and can be actuated so as to slide along said tubular element, and wherein a configuration for unloading the material, the plug being raised and the jacket being connected both to the inside of the container and to said lateral duct, and in a closing configuration, the plug being lowered so as to close said removal opening hermetically.

17. The mill according to claim 16, wherein said closure plug, said jacket and said control element are associated with a double-acting jack which is adapted to move said plug from the closure configuration to the unloading configuration and vice-versa.

18. A mill for grinding loose materials, comprising:

a closed container having a first and a second pole;

a fixed frame for supporting said container at said first and second poles;

a first coupling shaft articulated at said first pole;

a second coupling shaft articulated at said second pole;

a driving shaft;

a flange fixed to said driving shaft;

eccentric means with adjustable eccentricity, provided at said flange for supporting and actuating said second coupling shaft and said second pole to perform a substantially circular orbit;

fluid-actuated translatory motion elements for varying the eccentricity of said eccentric means to achieve various dimensions of said circular orbit;

centering means, provided at said fixed frame, to provide correct positioning of said first coupling shaft for each for the various dimensions of said circular orbit;

a self aligning support provided at said second coupling shaft;

a rotary coupling element for connecting said second coupling shaft, through said self aligning support, to said eccentric means;

a loading opening, provided at said container for introducing materials to be ground therein;

a removal opening, having a lateral unloading duct, provided at said container, for removing the ground materials; and control and plug elements which are actuatable, during grinding operation of the mill, between a position for opening said removal opening and allow discharge of the materials through said unloading duct, and a position for closing hermetically said removal opening.

* * * * *